US005629659A

United States Patent [19]

Steiner

[11] Patent Number: 5,629,659

[45] Date of Patent: May 13, 1997

[54] SINGLE SWITCHING OF MAGNETIC REED SWITCH

[76] Inventor: George A. Steiner, 58 Hillcrest Avenue, Montreal, Quebec, Canada, H8R 1J2

[21] Appl. No.: 551,301

[22] Filed: Oct. 31, 1995

[51] Int. Cl.[6] ..... H01H 9/00

[52] U.S. Cl. ..... 335/205; 335/207

[58] Field of Search ..... 335/205–207

[56] References Cited

U.S. PATENT DOCUMENTS

| | | | |
|---|---|---|---|
| 4,084,436 | 4/1978 | Smitherman | 73/313 |
| 4,627,283 | 12/1986 | Nishida et al. | 73/313 |
| 4,788,534 | 11/1988 | Engelhardt | 340/601 |
| 5,159,305 | 10/1992 | Hutchinson | 335/207 |
| 5,233,323 | 8/1993 | Burkett et al. | 335/207 |
| 5,299,456 | 4/1994 | Steiner | 73/308 |
| 5,325,078 | 6/1994 | Carothers | 335/206 |

*Primary Examiner*—Lincoln Donovan

*Attorney, Agent, or Firm*—Townsend and Townsend and Crew LLP

[57] ABSTRACT

A magnetic switching device utilizing a reed switch avoids multiple switching and provides greater movement between a magnet and a reed switch. The device has a reed switch switchable by a magnetic field with contact reeds extending longitudinally in a switching line, at one permanent bar magnet, and a path of movement for the magnet to move relative to the reed switch, the path of movement being parallel to the switching line of the reed switch and spaced apart a predetermined distance therefrom, the magnet being tilted at a predetermined angle to the switching line of the reed switch, the angle being sufficient to cause only a single switching action when movement occurs between the magnet and the reed switch in the path of movement, the switching action occurring when the approximate centre of the magnet substantially overlaps the contact reeds of the reed switch.

12 Claims, 3 Drawing Sheets

FIG. 4
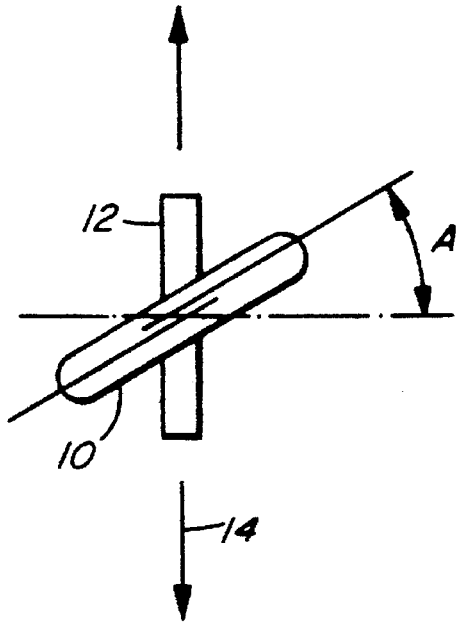
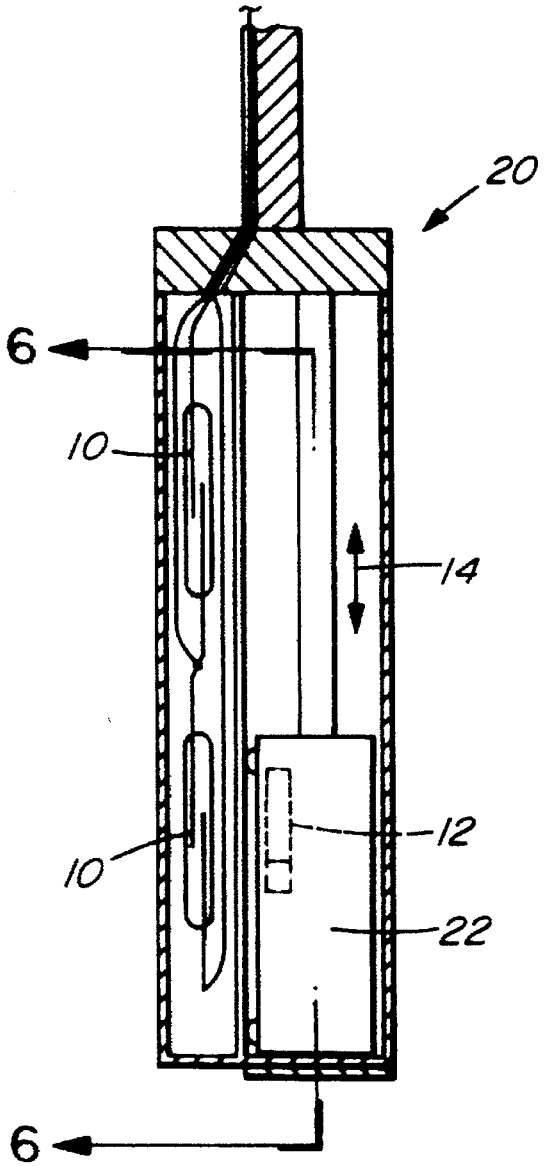
FIG. 5
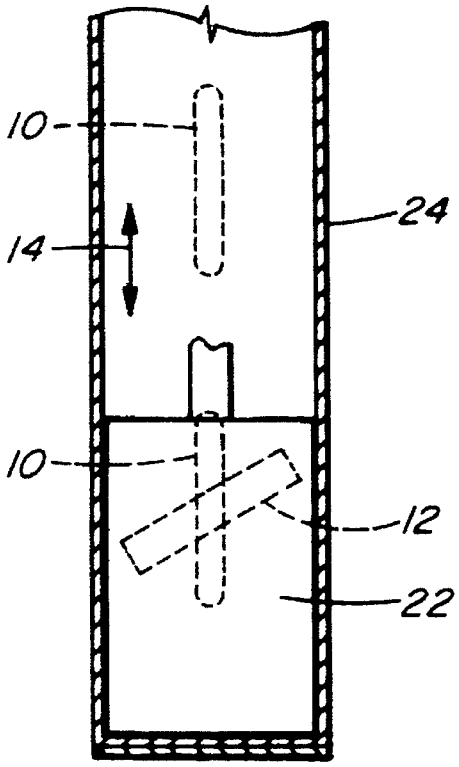
FIG. 6

SINGLE SWITCHING OF MAGNETIC REED SWITCH

TECHNICAL FIELD

The present invention relates to reed switches and more specifically to a reed switch which is triggered only once rather than having multiple switching.

BACKGROUND ART

Magnetic reed switches comprise two reeds made of magnetic material so that when magnetic field is applied the two reeds either contact each other or separate from each other to make or break a contact. Thus, when a permanent bar magnet passes a reed switch the contact between the reeds is either made or broken.

Reed switches are used in level measuring devices wherein a float with a magnet therein moves up and down adjacent a reed switch in a fixed position.

One example of utilizing a reed switch in a level measuring device is shown in my U.S. Pat. No. 5,299,456 entitled "Electronic Dipstick for Indicating the Oil Level of an Engine". Another use of reed switches is shown in U.S. Pat. No. 4,627,283 to Nishida et al. The latter patent illustrates multiple reed switches mounted at an angle in a vertical plane parallel to the movement of a float containing a permanent magnet. The reason for the angle mounting is to position the reed switches as close together as possible so that two switches are actuated simultaneously.

One problem that has always existed with reed switches is what is referred to as "multiple switching". This occurs when the permanent magnet moves in a path which is substantially parallel to a switching line of a reed switch. It does not occur if the magnet moves laterally away or towards the reed switch. In this latter situation there is only a single switching point, but the on/off distance is larger than that with a substantially parallel movement, providing a less accurate device which is seldom used in level sensing or position sensing applications.

The magnetic field from a permanent magnet moving in a path substantially parallel to the switching line of a reed switch causes three possible switching positions when the magnet is mounted with the magnetic poles substantially parallel to the reed switch. In order to avoid this, most reed switches in level sensing or position sensing applications have only a small movement between magnet and switch so that only one of the switching positions is activated.

In order to overcome the multiple switching without having to limit the movement of the permanent magnet, shielding is used. However, magnetic shielding is a costly and complicated method.

DISCLOSURE OF INVENTION

It is an aim of the present invention to provide an arrangement wherein multiple switching is eliminated when a permanent magnet moves substantially parallel to the switching line of a reed switch. This arrangement is particularly advantageous because it is this configuration that has the shortest on/off distance for a reed switch.

The present invention provides a magnetic switching device with single switching comprising: a reed switch switchable by a magnetic field with contact reeds extending longitudinally in a switching line; at least one permanent bar magnet; a path of movement for the permanent bar magnet to move relative to the reed switch, the path of movement being parallel to the switching line of the reed switch and spaced apart a predetermined distance therefrom, the permanent bar magnet being tilted at a predetermined angle to the switching line of the reed switch, the angle being sufficient to cause only a single switching action when movement occurs between the magnet and the reed switch in the path of movement, the switching action occurring when the approximate centre of the magnet substantially overlaps the contact reeds of the reed switch.

The present invention also provides a magnetic switching device with single switching comprising: a reed switch switchable by a magnetic field with contact reeds extending longitudinally in a switching line; at least one permanent bar magnet; a path of movement for the permanent bar magnet to move relative to the reed switch, the path of movement spaced apart a predetermined distance from the reed switch, the switching line of the reed switch being tilted at an angle to the permanent bar magnet, the angle being sufficient to cause only a single switching action when the magnet moves in the path of movement, the switching action occurring when the approximate centre of the magnet substantially overlaps the contact reeds of the reed switch.

BRIEF DESCRIPTION OF DRAWINGS

In drawings which illustrate embodiments of the present invention,

FIG. 4 is a front view showing a magnet mounted vertically and movable in a path of movement with a fixed reed switch mounted at an angle, FIG. 5 is a side elevation showing a level gauge with a float having a magnet mounted at an angle therein movable past two reed switches, FIG. 6 is a front view of the arrangement shown in FIG. 5 taken at line 6—6.

BEST MODE FOR CARRYING OUT THE INVENTION

Figure 1:
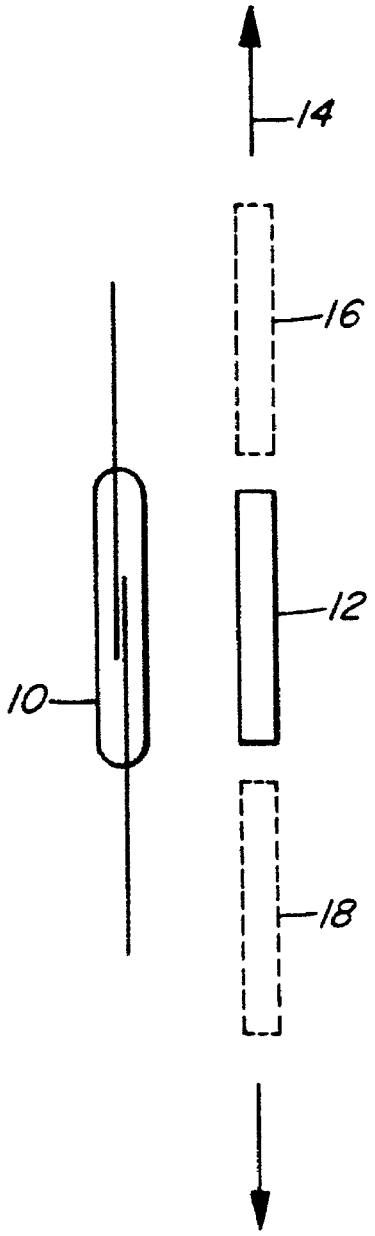
FIG. 1 PRIOR ART
FIG. 1 is a diagram showing a reed switch and a permanent bar magnet having a relative path of movement for the magnet extending on both sides of the reed switch, showing multiple switching positions as known in the prior art.

A reed switch 10 is shown in FIG. 1 of the type known wherein two reeds close so that contact points on the end of each reed make contact when a permanent bar magnet 12 passes thereby. The permanent bar magnet 12 moves in a path of movement 14 extending on both sides of the reed switch 10, and is shown in solid line opposite the reed switch 10 which is where switching action occurs. This is considered the main switching position and shown in dotted line top position 16 above and in dotted line bottom position 18 below are the two other positions that switching occurs in the known operation of a reed switch as presently used in the prior art. Thus, in order to avoid multiple switching it is necessary to either arrange shields around the top position 16 and the bottom position 18 to prevent switching occurring at these two positions or, alternatively, to ensure that the magnet 12 moves only a short distance in relation to the reed switch 10, and does not move through the top position 16 or the bottom position 18. Then only one switching position occurs and that is directly opposite the reed switch 10.

Figure 2:
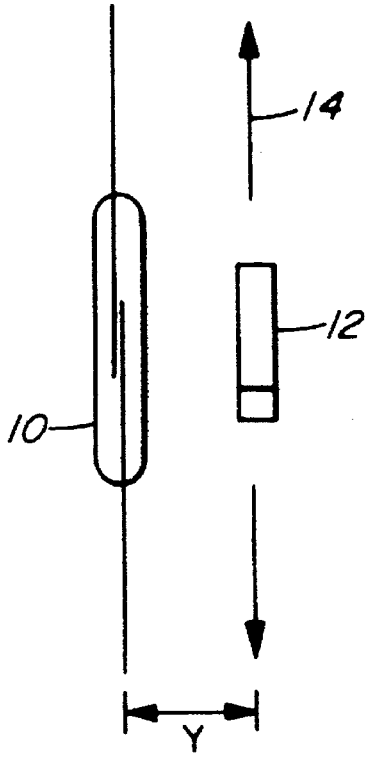
FIG. 2 is a side view showing a fixed reed switch with a permanent bar magnet moveable in a path of movement according to one embodiment of the present invention.
Figure 3:
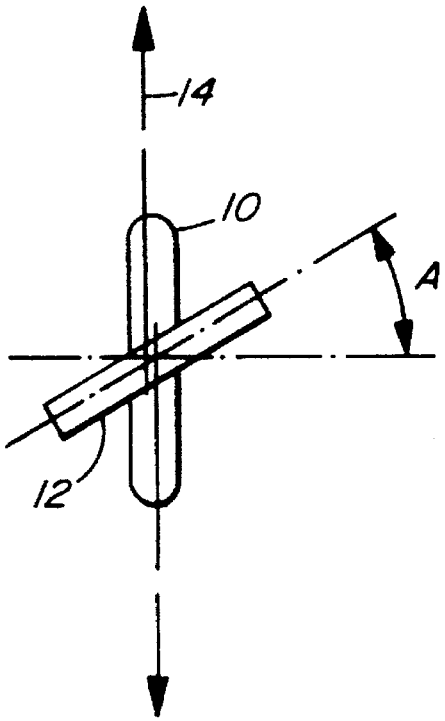
FIG. 3 is a front view of the arrangement shown in FIG. 2.

It has been found that by either rotating or tilting the reed switch at an angle relative to the path of movement of the permanent bar magnet or rotating the magnet at an angle in its relative path of movement, top the switching position 16 and bottom switching position 18 can be avoided and only one switching position exists, namely when the switch 10 and magnet 12 are opposite each other. The angle of the permanent magnet or the reed switch is important. If, for example, the permanent magnet 12 is placed with a line through the two magnetic poles perpendicular to the reed switch 10, then the reed switch is not tripped. Furthermore, the approximate centre of the permanent magnet 12 is positioned so that it is in line with a switching line of the reed switch 10. Referring to FIGS. 1 and 2, the reed switch 10 is shown spaced apart a predetermined distance Y from the path of movement 14 of the permanent magnet 12. The permanent magnet 12 is rotated or tilted to an angle A and this angle is determined empirically. The magnet 12 is positioned so that it is substantially symmetrical about the switching line of the reed switch 10. This switching line is parallel with the path of movement 14 as shown in FIGS. 2 and 3. If the magnet 12 is asymmetrical rather than symmetrical to the switching line, then multiple switching may occur. If, as stated, magnet 12 is perpendicular to the path of movement 14 then no switching occurs. If it is almost parallel with the path of movement, then multiple switching occurs so it must be positioned so that there is only one switching position which is when the magnet 12 is substantially opposite the reed switch 10. The other two switching positions illustrated as top position 16 and bottom position 18 shown in FIG. 1 do not occur when the magnet 12 is rotated to angle A. The reed switch 10 may have a normally open or normally closed contacts, the movement being activated by the permanent magnet. The distance Y shown in FIG. 2 is also determined empirically. If the distance is too great, the magnetic field does not cause switching to occur. It is placed as close as possible but the combination of the distance Y and the angle A are determined for consistent single switching when the magnet 12 is opposite the reed switch 10.

As illustrated in FIG. 4, the reed switch 10 is mounted at angle A and the permanent magnet 12 is shown mounted with the magnetic poles in line with the path of movement 14. While not shown, it will also be apparent that the magnet 12 may be stationary and the reed switch 10 move in the path of movement 14. There has to be differential movement between the magnet 12 and the reed switch 10 and provided the distance Y between the reed switch and the magnet 12 together with the angle A, representing the angle of tilt between the magnet 12 and the reed switch 10, permits only one switching action to occur when the approximate centre of the magnet 12 is opposite the reeds in the reed switch 10.

As shown in FIG. 5, two reed switches 10 are mounted one above the other in a level indicating device 20 a float 22 moves up and down in a cage 24 with a permanent magnet 12 in the float 22 spaced a predetermined distance apart from the two reed switches 10. As can be seen in FIG. 6, the permanent magnet is tilted at an angle which provides a single switching position as the float 22 rises in the cage 24 and the centre of the magnet 12 passes each reed switch 10. Thus, single switching action occurs only when the magnet 12 is opposite each reed switch 10.

Figure 7:
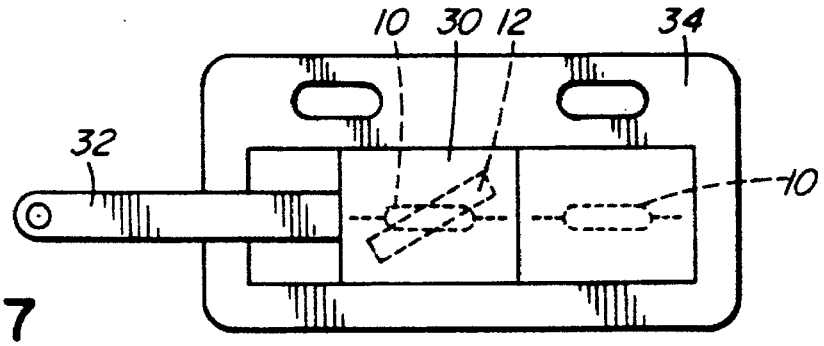
FIG. 7 is a plan view showing a positioning device with a slide having a permanent magnet mounted therein movable in a path past two reed switches.
Figure 8:
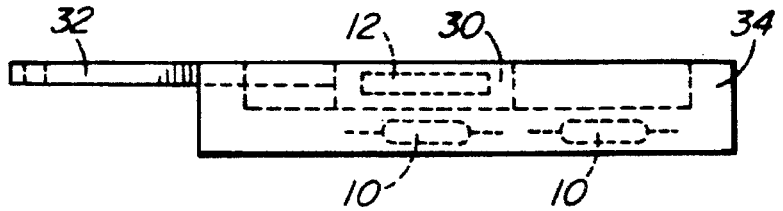
FIG. 8 is a side view of the positioning device shown in FIG. 7.

Another embodiment of the invention is shown in FIGS. 7 and 8, wherein a magnet 10 is mounted at a specific angle in a slide 30 with an arm 32 attached thereto. The slide 30 moves in a switch housing 34 between a first position and a second position, each position having a separate reed switch 10. As the slide 30 moves in the housing 34 each switch 10 is activated when the approximate centre of the magnet 12 is opposite the reeds of the switches. Multiple switching does not occur.

In commercial float level sensors utilizing a doughnut shaped float moving up and down on a shaft, the reed switch or switches are generally located within the shaft, and two bar magnets are used, one on each side of the float. The two bar magnets are positioned vertically substantially parallel to the movement of the float and have opposing polarity. Thus, the bar magnets are substantially parallel, one having a north pole uppermost and one having a south pole uppermost. The two bar magnets provide a strong magnetic field which is particularly useful if the gap between the float and the shaft is large allowing considerable sideways float. However, these float level sensors have restricted float movement to avoid multiple switching.

Figure 9:
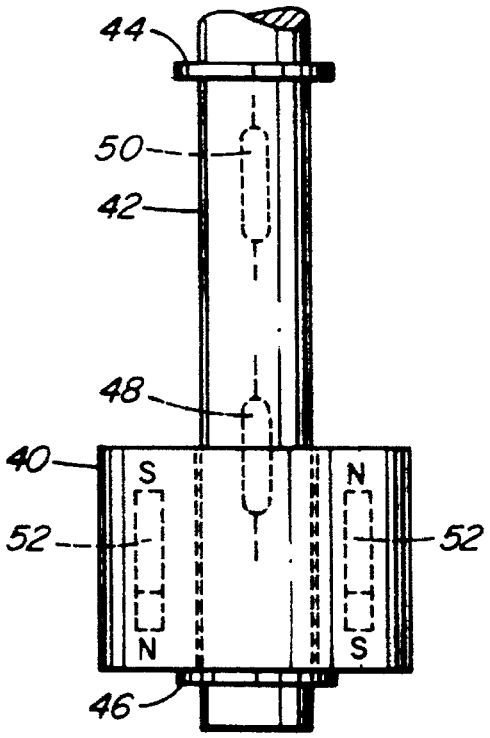
FIG. 9 is a side view of a doughnut shaped float movable on a shaft.
Figure 10:
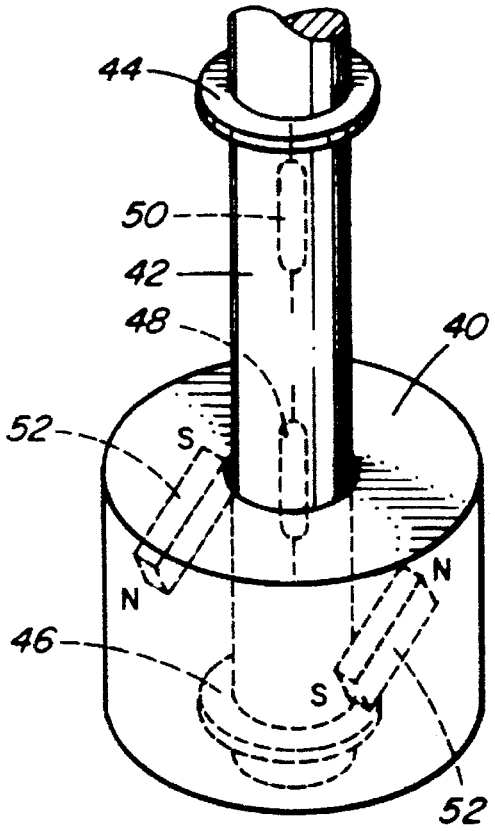
FIG. 10 is an isometric view of the float shown in FIG. 9.

A novel embodiment is shown in FIGS. 9 and 10 wherein a doughnut shaped float 40 is shown movable on a shaft 42 which has a top limit 44 and a bottom limit 46. The existing float switches of this type generally have only a single reed switch and the vertical movement of the float therefore has to be restricted to about a half inch, otherwise multiple switching occurs. In this embodiment, a lower reed switch 48 and an upper reed switch 50 are positioned in the approximate centre of the shaft 42, substantially in line with the shaft axis. The float 40 has two permanent bar magnets 52, one on each side of the shaft 42 and embedded in the float 40. The permanent magnets are sloped at an angle, with both magnets 52 parallel to each other and having opposite polarity.

Each switch 48,50 switches only once when the float 40 is level with the switch. The float need not stop at either the top switch 50 or bottom switch 48, but may be allowed to move above and below the switches. Furthermore, the number of switches may vary from one up to almost any number dependent upon the application. Each switch will switch only once when the float is level with that switch whether the float approaches from above or below the switch.

With a reed switch having a pull in the range of 22 to 23 ampere turns, and with a single magnet having an equivalent magnetic field strength of about 20 ampere turns at ½ inch (13 mm) it was found that if the angle A was 15° and the distance Y was ½ inch, the switch did not close. When the angle A was 25° and the distance Y was ¼ inch (6 mm) there was a single switching action. With the angle A of 45° and 50° and the distance Y being ⅜ inch (10 mm) there was also a single switching action. When the distance Y was ½ inch and the bar magnet was vertical or parallel to the reed switch, then multiple switching occurred. Thus, it was shown that a preferred angle range was 25° to 50° and the preferred distance range was ¼ to ½ inch although these ranges are only for the magnets and switches tested. These ranges are not limiting different angles and distances may be used for single switching by carrying simple tests with particular switches and magnets.

Various changes may be made to the embodiments shown herein without departing from the scope of the present invention which is limited only by the following claims.

The embodiments of the present invention in which an exclusive property or privilege is claimed are defined as follows:

1. A magnetic switching device with single switching comprising:

a reed switch switchable by a magnetic field with contact reeds extending longitudinally in a switching line;

at least one permanent bar magnet;

a path of movement for the permanent bar magnet to move relative to the reed switch, the path of movement being parallel to the switching line of the reed switch and spaced apart a predetermined distance therefrom, the permanent bar magnet being tilted at a predetermined angle to the switching line of the reed switch, the angle being sufficient to cause only a single switching action when movement occurs between the magnet and the reed switch in the path of movement, the switching action occurring when the approximate centre of the magnet substantially overlaps the contact reeds of the reed switch.

2. The magnetic switching device according to claim 1 wherein the permanent bar magnet moves in the path of movement and the reed switch is stationary.

3. The magnetic switching device according to claim 1 wherein the reed switch moves in the path of movement and the permanent bar magnet is stationary.

4. The magnetic switching device according to claim 1 wherein the reed switch is tripped to close when the permanent magnet is substantially opposite the reed switch.

5. The magnetic switching device according to claim 1 wherein the reed switch is tripped to open when the permanent magnet is substantially opposite the reed switch.

6. The magnetic switching device according to claim 2 wherein the permanent magnet is mounted on a float to form a float switch.

7. The magnetic switching device according to claim 6 wherein the float is a doughnut shape and moves vertically up and down on a shaft, the float having two permanent bar magnets therein, the magnets substantially parallel to each other and having opposite polarity.

8. A magnetic switching device with single switching comprising:

a reed switch switchable by a magnetic field with contact reeds extending longitudinally in a switching line;

at least one permanent bar magnet;

a path of movement for the permanent bar magnet to move relative to the reed switch, the path of movement spaced apart a predetermined distance from the reed switch, the switching line of the reed switch being tilted at an angle to the permanent bar magnet, the angle being sufficient to cause only a single switching action when the magnet moves in the path of movement, the switching action occurring when the approximate centre of the magnet substantially overlaps the contact reeds of the reed switch.

9. The magnetic switching device according to claim 8 wherein the reed switch is tripped to close when the magnet is substantially opposite the reed switch.

10. The magnetic switching device according to claim 8 wherein the reed switch is tripped to open when the magnet is substantially opposite the reed switch.

11. The magnetic switching device according to claim 8 wherein the permanent bar magnet is positioned on a float to form a float switch.

12. The magnetic switching device according to claim 11 wherein the float is a doughnut shape and moves vertically up and down on a shaft, the float having two permanent bar magnets therein, the magnets substantially parallel to each other and having opposite polarity.

* * * * *